US008870406B2

(12) United States Patent
Ruriani et al.

(10) Patent No.: US 8,870,406 B2
(45) Date of Patent: Oct. 28, 2014

(54) COVER FOR A COMPACT FLUORESCENT LIGHT BULB

(76) Inventors: Kathy Ruriani, Valrico, FL (US); Charles Joseph Rodriguez, Clearwater, FL (US)

( * ) Notice: Subject to any disclaimer, the term of this patent is extended or adjusted under 35 U.S.C. 154(b) by 125 days.

(21) Appl. No.: 13/571,955

(22) Filed: Aug. 10, 2012

(65) Prior Publication Data

US 2014/0043832 A1 Feb. 13, 2014

(51) Int. Cl.
*F21V 21/00* (2006.01)

(52) U.S. Cl.
USPC ..... 362/217.1; 362/217.11; 362/260; 362/362

(58) Field of Classification Search
USPC ..... 362/217.1, 217.11, 218, 260, 294, 319, 362/362, 373
See application file for complete search history.

(56) References Cited

U.S. PATENT DOCUMENTS 4,878,159 A 10/1989 Blaisdell et al.
5,537,301 A * 7/1996 Martich ..... 362/218
5,567,045 A 10/1996 Bucek
6,155,695 A 12/2000 Sealy
6,296,375 B1 10/2001 Sung et al.
7,434,961 B1 10/2008 Bernhardt et al.
7,798,674 B2 9/2010 Bernhardt et al.
2010/0002451 A1 1/2010 Reynolds
2011/0044055 A1 2/2011 Singer
2011/0181172 A1 7/2011 Gruber
2011/0242823 A1 10/2011 Tracy et al.

* cited by examiner

*Primary Examiner* — Mary McManmon
*Assistant Examiner* — Meghan Dunwiddie
(74) *Attorney, Agent, or Firm* — Maxey Law Offices, PLLC; Stephen Lewellyn

(57) ABSTRACT

A cover for a compact fluorescent light (CFL) bulb is provided. The cover includes a housing formed of clamshell sections that are mutually engageable about the CFL bulb and, when engaged, define an upper body portion having an interior for receiving the CFL bulb and a cylindrically-shaped neck extending downwardly from the upper body portion for encircling a base of the CFL bulb. A resilient member extends inwardly from opposite sides of the cylindrically-shaped neck and is biasable against the base of the CFL bulb to grip and retain the base when the clamshell sections are mutually engaged to secure the cover to the CFL. The cover may also include a flange defining a rectangular slot through which the CFL bulb is extendable to facilitate securing the bulb to a light socket.

17 Claims, 3 Drawing Sheets

COVER FOR A COMPACT FLUORESCENT LIGHT BULB

FIELD OF THE INVENTION

The present invention relates generally to light bulbs, and more particularly, relating to a decorative and protective cover for a compact fluorescent light bulb.

BACKGROUND OF THE INVENTION

Many world governments are passing restrictions or complete prohibitions on the continued use of conventional incandescent light bulbs because of the relatively poor energy efficiency when compared to newer lighting technology, such as compact fluorescent light bulbs (CFLs). Despite the cheaper energy costs associated with CLFs, consumers are reluctant to adopt use of CFLs because they do not have an aesthetically pleasing appearance. Another drawback of CFLs relate to the environmental and health concerns due to the bulbs containing mercury.

There have been attempts in the art to provide coverings or caps to improve the appearance and/or protect the CFLs from breaking. The devices heretofore, however, have several drawbacks, and the most significant drawbacks include the inability of the cover to attach or secure to CFLs of different sizes; different base diameters; and different contours, and the inability to thread the CFLs to a light socket with the cover attached.

Accordingly, there is a need for a new cover for CFLs of a design having a variable fit or securement system that permits securing the cover to CFLs of various sizes and of various base constructions. There is also a need for a new cover for CFLs of a design that is attachable to the CFL prior to threading into a light socket and that facilitates the threading of the CFL into the light socket. There is also a need for a new cover for CFLs of a design that minimizes manufacture costs, thus permitting the cover to be sold a cost that is readily absorbable by the consumer market.

SUMMARY OF THE INVENTION

The embodiments of the present invention address these need by providing a cover for CFLs of a new design that have a variable fit mechanism permitting the cover to be attached to CFLs of different sizes and constructions that may be attached to a CFL prior to installing the CFL in a light socket, and that have a simplified design permitting reduced manufacturing costs.

To achieve these and other advantages, in general, in one aspect, a cover for a compact fluorescent light bulb includes a housing formed of a first clamshell section and a second clamshell section that are mutually engageable, and when engaged, define an upper body portion defining an interior for receiving the compact fluorescent light bulb and a cylindrically-shaped neck extending downwardly from the upper body portion for encircling a base of the compact fluorescent light bulb. At least one resilient member extends inwardly from opposite sides of the cylindrically-shaped neck and is biasable against the base of the compact fluorescent light bulb, such that opposite and inwardly forces are exerted upon the base of the compact fluorescent light bulb when the first and the second clamshell sections are mutually engaged about the fluorescent light bulb.

In general, in another aspect, a flange intermediate the upper body portion and the cylindrically-shaped neck and extending inwardly and radially around the housing is provided, the flange defining a rectangular slot through which the fluorescent light bulb is extendable.

In general, in another aspect, the at least one resilient member is a cantilever tab attached at one end to said housing and terminating at an inwardly disposed free end.

There has thus been outlined, rather broadly, the more important features of the invention in order that the detailed description thereof that follows may be better understood and in order that the present contribution to the art may be better appreciated.

Numerous objects, features, and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages, and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
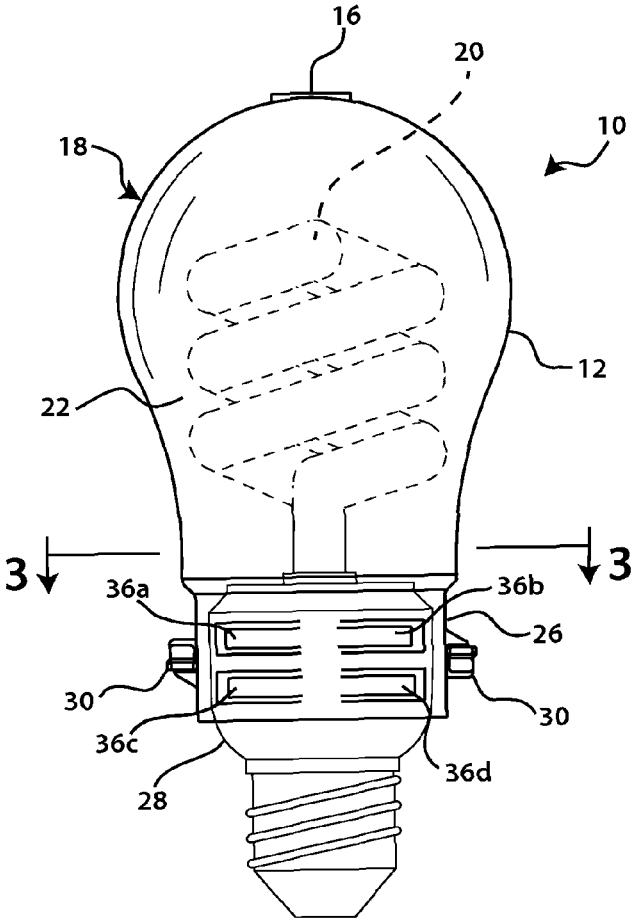
FIG. 1 is a front elevation view of a cover for a CFL constructed in accordance with the principles of an embodiment the present invention and secured to and encasing a CFL.
Figure 2:
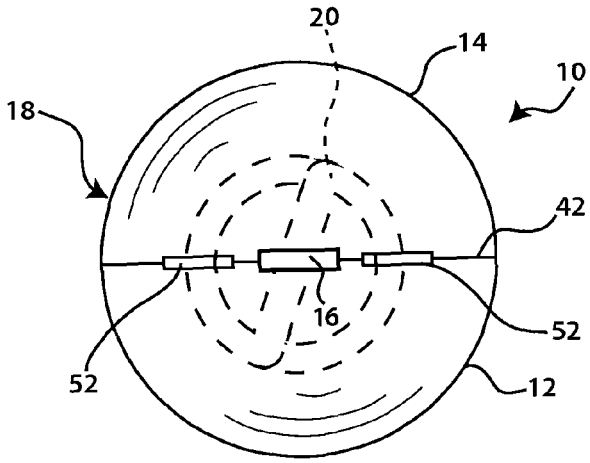
FIG. 2 is a top plan view of the cover of FIG. 1.

As a preliminary matter, it should be noted that in this document (including the claims) directional terms, such as "above", "below", "upper", "lower", etc., are used for convenience in referring to the accompanying drawings. Additionally, it is to be understood that the various embodiments of the invention described herein may be utilized in various orientations, such as inclined, inverted, horizontal, vertical, etc., without departing from the principles of the invention.

With reference now to FIGS. 1 through 7 of the drawings, a new cover for a compact fluorescent light (CFL) bulb embodying the principles and concepts of an embodiment of the present invention, and generally designated by the reference number 10, will be described.

The cover 10 includes a housing 18 having a pair of clamshell sections 12 and 14 that are pivotally connected together by a living hinge 16. Housing 18, including the two clamshell sections 12 and 14, and the living hinge 16, are molded as a unitary body from a suitable plastic material. The plastic material may be transparent or translucent. The housing 18 may be molded in a manner such that portions of the body may be a combination of transparent, translucent, or even opaque, as desired. Additionally, the housing may be tinted with a desired color, pattern, and/or frosted, as desired.

The living hinge 16 permits the two clamshell sections to rotate toward and away from one another for encasing and securing to a CFL bulb 20. The clamshell sections 12 and 14 are mutually engageable when rotated together and, when engaged, define the housing 18 to have an upper body portion 22 that defines an interior space 24 for receiving therein the CFL bulb 20, and a cylindrically-shaped neck portion 26 extending downwardly from the upper body portion for encircling a base 28 of the CFL bulb.

Figure 5:
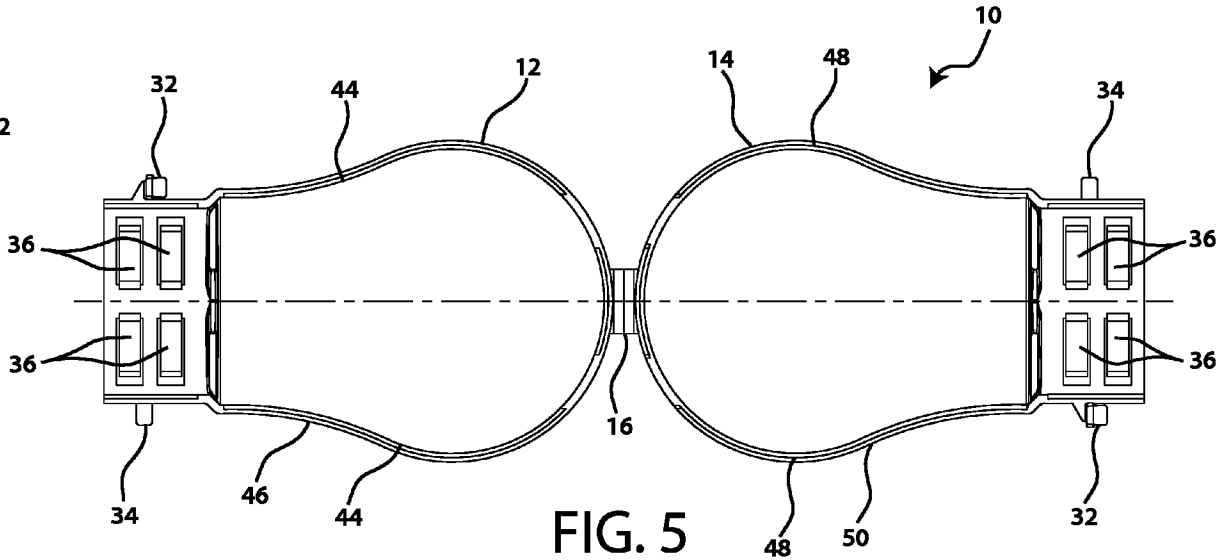
FIG. 5 is a top plan view of cover for a CFL constructed in accordance with the principles of an embodiment the present invention shown in an open and non-engaged configuration.
Figure 6:
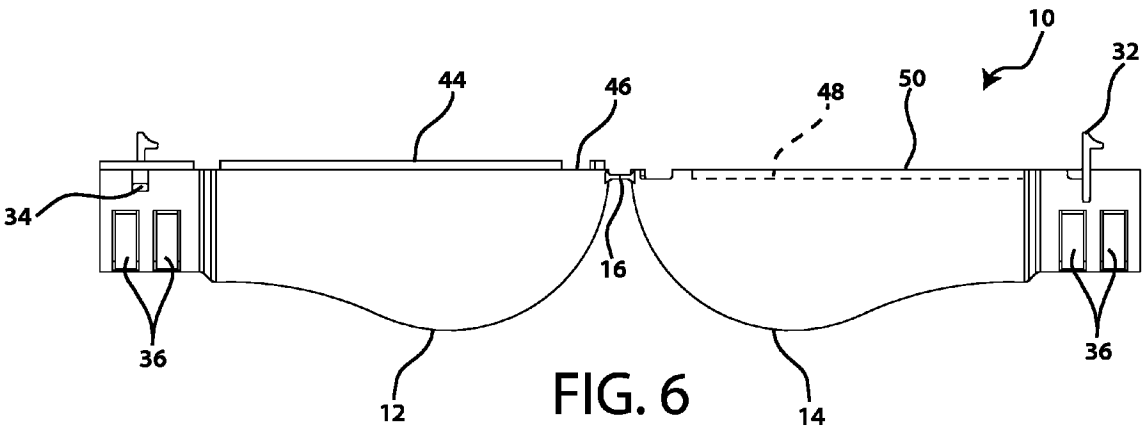
FIG. 6 is a side elevation view of the cover of FIG. 5.
Figure 7:
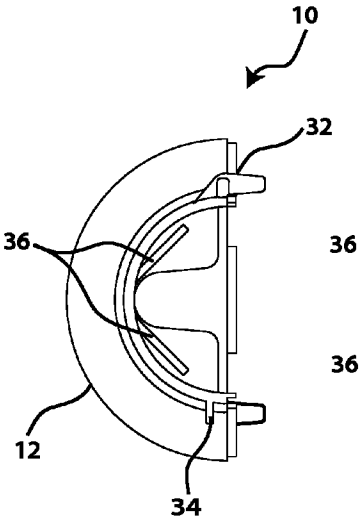
FIG. 7 is an end view of the cover of FIG. 5.

In an embodiment, the two clamshell sections 12 and 14 are mutually engaged and are secured together against disengagement by a pair of latches 30 that are disposed on opposite sides of the housing 18 (as best seen in FIG. 1). The latches 30 may be of any configuration that permits the releasable engagement between the two clamshell sections 12 and 14. As best seen in FIGS. 5, 6, and 7, and in the illustrated exemplary configuration, each latch 30 includes a resilient latch beam 32 disposed on one clamshell that is releasably engageable with a latch base 34 disposed on the opposite clamshell. Other latch configurations are possible, and the invention is not limited in any manner to the illustrated exemplary configuration. In embodiments, the cover 10 may not include latches 30 and may include another mutually engageable structure while still remaining within the scope of the invention.

The cover 10 is secured to the base 28 of the CFL 20 by at least one, preferably at least two, and most preferably, four resilient members 36, extending inwardly from opposite sides of the cylindrically-shaped neck and being biasable against the base 28 of the CFL bulb such that the base is held between the resilient members when the first and the second clamshell sections 12 and 14 are mutually engaged about the CFL bulb.

Figure 3:
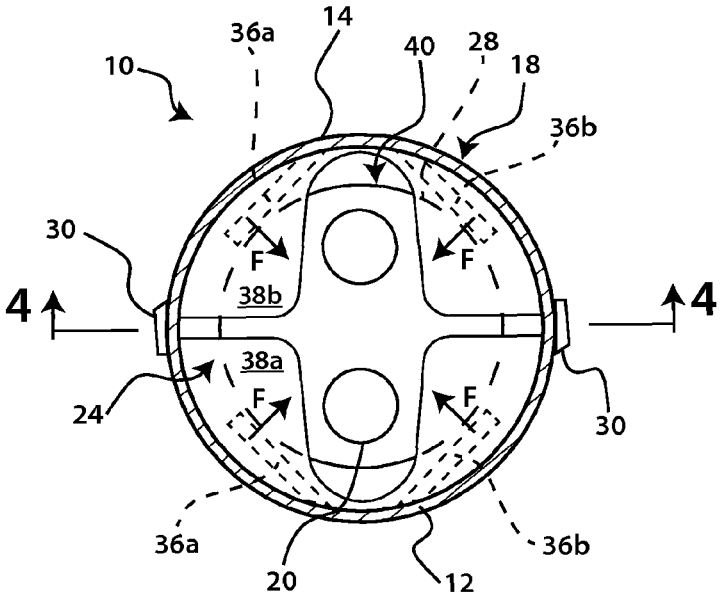
FIG. 3 is a cross sectional view of the cover attached to the CFL taken along line 3-3 in FIG. 1, and illustrates the CFL extending through a rectangular shaped slot formed through a flange extending horizontally across the interior of the cover.
Figure 4:
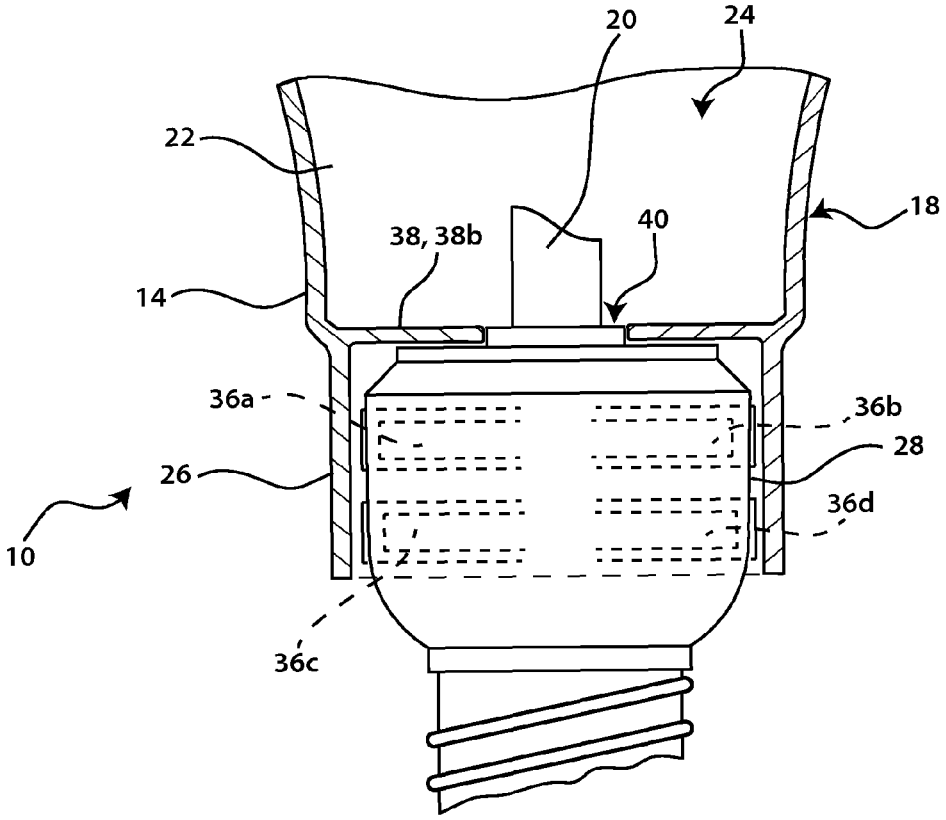
FIG. 4 is an enlarged, partial cross-section view of the cover attached to the CFL taken along line 4-4 in FIG. 3, and further illustrates the CFL extending through the rectangular slot and also illustrates the flange aligning securing tabs to the base of the CFL.

As best seen in FIGS. 1, 3, and 4, in an embodiment, each clamshell section 12, 14 includes four resilient cantilever tab members 36*a*-36*d*. Each cantilever tab 36*a*-36*d* is attached at one end to its respective clamshell section 12, 14 and inwardly extends or projects therefrom and terminates at a free end. Cantilever tabs 36*a* and 36*b* are arranged horizontally and side-by-side and project from clamshell section 12, 14 in generally inwardly and opposite directions, as best seen in FIG. 3. Similarly, cantilever tabs 36*c* and 36*d* are arranged horizontally and side-by-side at a vertically lower position from tabs 36*a* and 36*b*, and project from clamshell section 12, 14 in a generally inwardly and opposite directions. Cantilever tabs 36*a* and 36*c* project in the same direction, and cantilever tabs 36*b* and 36*d* project in the same directions.

Cantilever tabs 36*a*-36*d* are resiliently biased inwardly and are caused to deflect in a radially outwardly direction when engaged with the base 28 of the CLF bulb 20 when clamshell sections 12 and 14 are engaged about the CFL bulb. As best seen in FIG. 3, diametrically opposite cantilever tabs exert a force F upon the base 28 in opposite directions which serve to grip the base between the cantilever tabs and secure the cover 10 to the CFL bulb 20. In an embodiment, cantilever tabs 36*a*-36*d* are formed integral with clamshell sections 12, 14, such that the entire cover 10 can be molded as a unitary one-piece member.

The resilient members 36 serve to adjustably secure the cover 10 to the various diameters and contours of CFL bulb bases found across different CFL bulb manufactures. This functional aspect is illustrated in the embodiment of the invention including the cantilever tab members 36*a*-36*d* as the resilient members.

The cover 10 further includes a flange 38 intermediate the upper body portion 22 and the cylindrically-shaped neck portion 26 that extends inwardly and radially around the housing 18. Flange 38 is comprised of two half-flange portions 38*a* and 38*b* integral with clamshell sections 12 and 14, respectively. Flange 38 (38*a*, 38*b*) serves to abut or engage a top surface of the base 28 and thereby align resilient members 36*a*-36*d* with the base for correct engagement therewith.

Flange 38 defines a rectangular slot 40 through which the CFL bulb 20 extends from the base 28 and into the interior space 24 of the upper body portion 22. In addition to providing a passage for the CFL bulb 20 across flange 38, the rectangular slot 40 also serves to restrain relative rotation between the cover 10 and the CFL bulb. That is, with reference to FIG. 3, it can be seen that the cover 10 is permitted to only rotate through a relatively small angle of rotation before the CFL bulb 20 engages with the peripheral edge of the rectangular slot 40 and then bulb is caused to rotate conjointly with the cover, thereby permitting a user to rotate the cover 10 to threadably insert or remove the bulb from a light socket without having to physically grip the bulb itself.

To prevent separation of clamshell sections 12 and 14 along the engagement seam 42 therebetween, such as, for example, when installing or removing a CFL bulb from a socket, the cover 10 may further include a rib 44 that extends from a peripheral edge 46 of clamshell section 12 that is received within a corresponding groove 48 formed along a confronting peripheral edge 50 of clamshell section 14 when the clamshell sections are mutually engaged.

Although CFL bulbs operate at a generally low temperature when compared to other lights, such as an incandescent light bulb, the cover 10 may further include one or more air vents 52 formed through the upper body portion 22 to permit venting of heat air from the cover 10.

A number of embodiments of the present invention have been described. Nevertheless, it will be understood that various modifications may be made without departing from the spirit and scope of the invention. For example, although the upper body portion 22 is depicted here to be generally bulbous in shape to resemble the shape of a traditional incandescent light bulb, the upper body portion may be of different shapes, as desired. For example, the body portion 22 may be shaped to coordinate with various holiday seasons, various décor themes, and/or various character themes. Accordingly, other embodiments are within the scope of the following claims.

What is claimed is:

1. A cover for a compact fluorescent light bulb comprising:

a housing formed of a first clamshell section and a second clamshell section that are mutually engageable and, when engaged, define an upper body portion defining an interior for receiving the compact fluorescent light bulb and a cylindrically-shaped neck extending downwardly from said upper body portion for encircling a base of the compact fluorescent light bulb; and at least one resilient member extending inwardly from opposite sides of said cylindrically-shaped neck and applying opposite and inwardly forces against the base of the compact fluorescent light bulb when said first and said second clamshell sections are mutually engaged about the fluorescent light bulb.

2. The cover of claim 1, further comprising:

a flange intermediate said upper body portion and said cylindrically-shaped neck and extending inwardly and radially around the housing, said flange defining a rectangular slot through which the fluorescent light bulb is extendable.

3. The cover of claim 1, wherein said housing further defines one or more air vents through said upper body portion.

4. The cover of claim 1, further comprising:

a rib extending from peripheral edge of said first clamshell section that is received within a corresponding groove formed along a peripheral edge of said second clamshell section when said first and said second clamshell sections are mutually engaged.

5. The cover of claim 1, further comprising:

a hinge pivotally connecting said first and said second clamshell sections together.

6. The cover of claim 1, wherein said at least one resilient member is a cantilever tab attached at one end to said housing and terminating at an inwardly disposed free end.

7. The cover of claim 6, wherein said cantilever tab is formed integral with said housing.

8. A cover for a compact fluorescent light bulb comprising:

a housing having a first clamshell section, a second clamshell section, and a living hinge pivotally connecting said first and said second clamshell sections together for rotation toward and away from each other to fit over and enclose a compact fluorescent light bulb, said first and said second clamshell section being mutually engageable and, when engaged, define an upper body portion defining an interior for receiving the compact fluorescent light bulb and a cylindrically-shaped neck extending downwardly from said upper body portion for encircling a base of the compact fluorescent light bulb;

at least one resilient cantilever tab extending inwardly from opposite sides of said cylindrically-shaped neck and applying opposite and inwardly forces against the base of the compact fluorescent light bulb when said first and said second clamshell sections are mutually engaged about the fluorescent light bulb; and a flange formed integral with said housing and disposed intermediate said upper body portion and said cylindrically-shaped neck and extending inwardly and radially around the housing, said flange defining a rectangular slot through which the fluorescent light bulb is extendable.

9. The cover of claim 8, wherein said housing further defines one or more air vents through said upper body portion.

10. The cover of claim 8, further comprising:

a rib integral with and extending from peripheral edge of said first clamshell section that is received within a corresponding groove formed along a peripheral edge of said second clamshell section when said first and said second clamshell sections are mutually engaged.

11. The cover of claim 8, wherein said upper body portion is bulbous shaped.

12. A combination of a compact fluorescent light bulb and a cover for the same comprising:

a compact fluorescent light bulb having a base;

a cover enclosing said compact fluorescent light bulb, said cover having a housing formed of a first clamshell section and a second clamshell section that are mutually engaged and define an upper body portion defining an interior in which said compact fluorescent bulb is disposed, and a cylindrically-shaped neck extending downwardly from said upper body portion which encircles said base of said compact fluorescent light bulb; and said cover further having at least one resilient member extending inwardly from opposite sides of said cylindrically-shaped neck and applying opposite and inwardly forces against said base.

13. The combination of claim 12, wherein said cover further comprises:

a flange intermediate said upper body portion and said cylindrically-shaped neck and extending inwardly and radially around the housing, said flange defining a rectangular slot through which the fluorescent light bulb is extends.

14. The combination of claim 12, wherein said cover further comprises:

a rib integral with and extending from a peripheral edge of said first clamshell section that is received within a corresponding groove formed along a peripheral edge of said second clamshell section.

15. The combination of claim 12, wherein said at least one resilient member is a cantilever tab attached at one end to said housing and terminating at an inwardly disposed free end.

16. The combination of claim 15, wherein said cantilever tab is formed integral with said housing.

17. The combination of claim 15, wherein each of said first and said second clamshell sections have at least four of said cantilever tabs.

* * * * *